US011209747B2

(12) United States Patent
Moon et al.

(10) Patent No.: US 11,209,747 B2
(45) Date of Patent: Dec. 28, 2021

(54) DISPENSERS WITH PLUNGERS

(71) Applicant: HEWLETT-PACKARD DEVELOPMENT COMPANY, L.P., Spring, TX (US)

(72) Inventors: Jiwon Moon, Pangyo (KR); Woongyong Choi, Suwon (KR); Matthew James Storey, Austin, TX (US); Jefferson Blake West, Austin, TX (US); Bennett Alexander Nadeau, Austin, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/046,370

(22) PCT Filed: Aug. 30, 2018

(86) PCT No.: PCT/US2018/048805

§ 371 (c)(1),
(2) Date: Oct. 9, 2020

(87) PCT Pub. No.: WO2020/046330

PCT Pub. Date: Mar. 5, 2020

(65) Prior Publication Data

US 2021/0132522 A1 May 6, 2021

(51) Int. Cl.
*G03G 15/08* (2006.01)
*B41J 2/175* (2006.01)

(52) U.S. Cl.
CPC ..... *G03G 15/0867* (2013.01); *B41J 2/17523* (2013.01); *G03G 15/0877* (2013.01)

(58) Field of Classification Search
CPC ..... G03G 15/0865; G03G 15/0877; G03G 15/0879; G03G 2215/0668
USPC ..... 399/120, 252, 258, 262, 263; 222/449, 222/DIG. 1
See application file for complete search history.

(56) References Cited

U.S. PATENT DOCUMENTS

| | | | | |
|---|---|---|---|---|
| 5,148,222 A * | 9/1992 | Lior | G03G 15/0121 399/233 |
| 5,673,073 A | 9/1997 | Childers et al. | |
| 6,213,597 B1 | 4/2001 | Liu | |
| 6,434,353 B1 * | 8/2002 | Kwak | G03G 15/104 222/449 |
| 2005/0157110 A1 | 7/2005 | Silverbrook | |

FOREIGN PATENT DOCUMENTS

| | | |
|---|---|---|
| CN | 201900800 | 7/2011 |
| EP | 2875836 | 5/2015 |
| KR | 101343645 | 12/2013 |
| WO | WO-2004103710 | 12/2004 |

* cited by examiner

*Primary Examiner* — Hoan H Tran
(74) *Attorney, Agent, or Firm* — Trop Pruner & Hu, P.C.

(57) ABSTRACT

In some examples, a print material particles dispenser, including: a print material area with an output area that includes an output channel that is positioned away from a central axis of the print material area, and a structure adapted to decrease a volume of the print material area to output print material particles through the output channel of the print material area.

20 Claims, 5 Drawing Sheets

DISPENSERS WITH PLUNGERS

BACKGROUND

Imaging systems, such as printers, copiers, etc., may be used to form markings on a physical medium, such as text, images, etc. In some examples, imaging systems may form markings on the physical medium by performing a print job. A print job can include forming markings such as text and/or images by transferring a print substance (e.g., ink, toner, etc.) to the physical medium.

DETAILED DESCRIPTION

Figure 1:
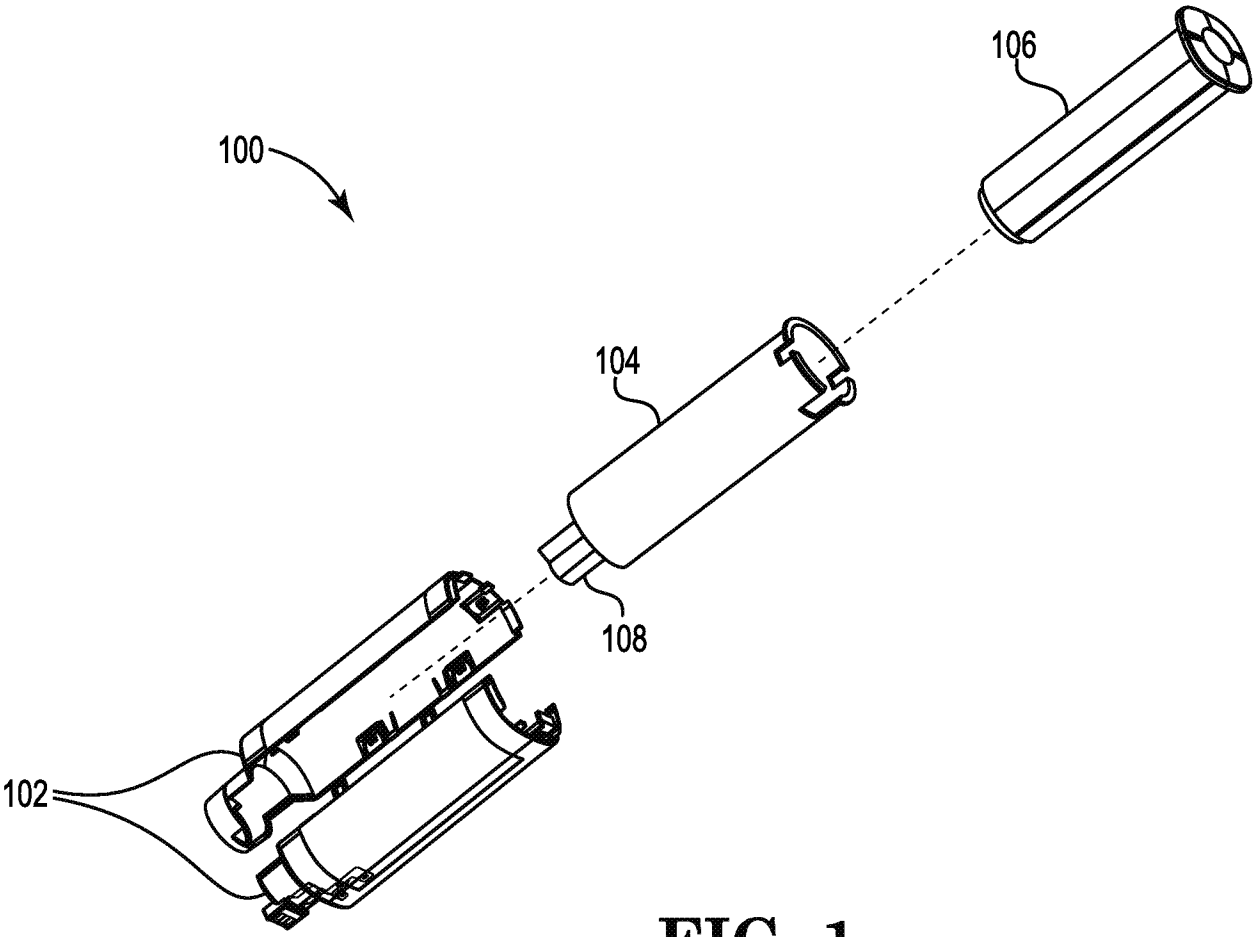
FIG. 1 illustrates an exploded view of an example of a print material particles dispenser consistent with the disclosure.

Imaging devices may include a dispenser of a print material particles located in a reservoir. As used herein, the term "print material particles" refers to a substance which, when applied to a medium, can form representation(s) on the medium during a print job. In some examples, the print material particles can be deposited in successive layers to create three-dimensional (3D) objects. For example, print material particles can include a powdered semi-crystalline thermoplastic material, a powdered metal material, a powdered plastic material, a powdered composite material, a powdered ceramic material, a powdered glass material, a powdered resin material, and/or a powdered polymer material, among other types of powdered or particulate material. The print material particles can be particles with an average diameter of less than one hundred microns. For example, the print material particles can be particles with an average diameter of between 0-100 microns. However, examples of the disclosure are not so limited. For example, print material particles can be particles with an average diameter of between 20-50 microns, 5-10 microns, or any other range between 0-100 microns. The print material particles can be fused when deposited to create 3D objects.

The print material particles can be deposited onto a physical medium. As used herein, the term "imaging device" refers to any hardware device with functionalities to physically produce representation(s) on the medium. In some examples, the imaging device can be a 3D printer. For example, the 3D printer can create a representation (e.g., a 3D object) by depositing print material particles in successive layers to create the 3D object.

The reservoir including the print material particles may be inside of the imaging device and include a quantity of the print material particles such that the imaging device may draw the print material particles from the reservoir as the imaging device creates the images on the print medium. As used herein, the term "reservoir" refers to a container, a tank, and/or a similar vessel to store a quantity of the print material particles for use by the imaging device.

As the imaging device draws the print material particles from the reservoir, the amount of print material particles in the reservoir may deplete. As a result, the amount of print material particles in the reservoir of the imaging device may have to be replenished.

A print material particles dispenser may be utilized to fill and/or refill the reservoir of the imaging device with print material particles. During a fill and/or refill operation, the print material particles dispenser can transfer print material particles from the print material particles dispenser to the reservoir of the imaging device. The print material particles dispensers described herein can utilize a structure and/or a plunger that is shaped differently than an output area of an inner body of the print material particles dispenser. In some examples, a shape of the plunger can allow the print material particles to be dispensed through an output channel connected to the output area without being jammed by the shape and size of the print material particles.

FIG. 1 illustrates an exploded view of an example of a print material particles dispenser 100 consistent with the disclosure. Print material particles dispenser 100 can include outer body 102, inner body 104, print material output channel 108, and a structure 106, As illustrated in FIG. 1, print material particles dispenser 100 can include inner syringe body 102. As used herein, the term "inner syringe body" refers to an inner structure of a syringe. As used herein, the term "syringe" refers to a reciprocating pump including a plunger and a tube, where the plunger can be linearly moved to allow the syringe to take in and/or expel liquid or gas through an orifice at the end of the tube. The inner body 104 can be a print material reservoir. For example, the print material reservoir can store a dispenser of print material particles. The print material reservoir can supply/resupply an imaging device (e.g., a host print system), as is further described herein.

Print material particles dispenser 100 can include a structure 106. As used herein, the term "structure" refers to a piston to take in and/or expel liquid, solid particles, and/or gas through the print material particles output channel 108 at the end of inner body 104. For example, the inner body 104 can be a tube (e.g., cylindrical tube, etc.) that can include print material particles, and structure 106 can take in and/or expel the print material particles, as is further described herein. Structure 106 can be a structure to adapt a volume of the print material reservoir (e.g., inner body 104). For example, structure 106 can increase or decrease a volume of the inner body 104 based on movement of structure 106 in the inner body 104.

Inner body 104 can include print material output channel 108. As used herein, the term "print material output channel" refers to an opening through which material can be moved. For example, print material output channel 108 can be an opening through which print material particles can be moved in response to structure 106 decreasing the volume of inner body 104 based on movement of structure 106 in the inner body 104.

Although not illustrated in FIG. 1 for clarity and so as not to obscure examples of the disclosure, structure 106 can include a plunger. As used herein, the term "plunger" refers to a projection of material. For example, structure 106 can include a small projection of material to engage the print material particles, as is further described herein.

Although not illustrated in FIG. 1 for clarity and so as not to obscure examples of the disclosure, the structure 106 can be located in the inner body 104. For example, structure 106 can be coaxially located in the inner body 104 to allow the structure 106 to take in print material particles to and/or expel print material particles from the inner body 104.

Print material particles dispenser 100 can include outer body 102. As used herein, the term "outer body" refers to an outer structure of a print material particles dispenser 100. For example, the outer body 102 can be an outer structure of print material particles dispenser 100 and can include an inner body 104 and a structure 106. In some examples, the print material particles dispenser 100 can be utilized to dispense print material particles (e.g., toner, etc.) into an imaging device (e.g., printing device, printer, etc.).

Figure 2:
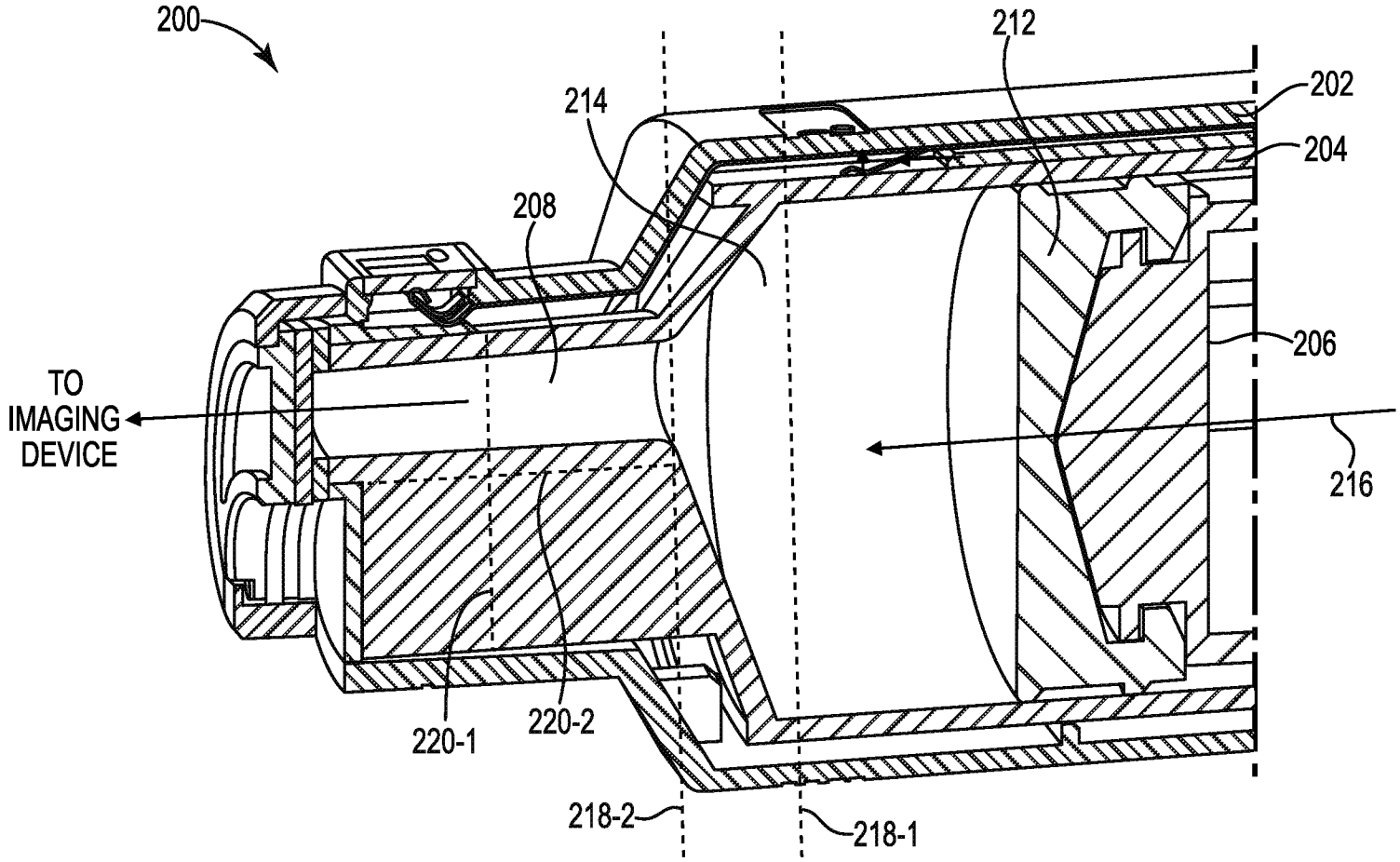
FIG. 2 illustrates a partial view of a portion of a print material particles dispenser consistent with the disclosure.

FIG. 2 illustrates a partial view of a portion of a print material particles dispenser 200 consistent with the disclosure. Print material particles dispenser 200 can include an inner body 204 to store print material particles, an outer body 202 covering the inner body 204, and a structure 206 located within the inner body 204. In some examples, the structure 206 can include a plunger 212 to interact with the print material particles stored within the inner body 204. In some examples, the inner body 204 can define a print material particles area to store the print material particles.

In some examples, the structure 206 can be directly coupled to the plunger 212, In some examples, the structure 206 can be directed in the direction of arrow 216 to move the print material particles toward the output channel 208 and into the output channel 208. In some examples, the output channel 208 can be coupled to an imaging device or print material particles reservoir of an imaging device. In some examples, the print material particles reservoir can be utilized to store print material particles for an imaging device. In these examples, the print material particles dispenser 200 can be utilized to refill or replenish the print material particles reservoir of an imaging device.

In some examples, the portion of the structure 206 that interacts with the print particles (e.g., plunger 212, etc.) is a different material than a remaining portion of the structure 206. In some examples, the structure 206 can be made of a first material and the plunger 212 can be made of a second material that is different than the first material. For example, the structure 206 can be made of a metallic material and/or polymer material and the plunger 212 can be made of a different material such as a different polymer material. In some examples, the print material particles dispenser 200 can include an output area 214, In some examples, the output area 214 can be utilized to direct print material particles toward an output channel 208. For example, the output area 214 can be shaped with a taper that is directed toward the output channel 208.

In some examples, a shape of the plunger 212 can be a first shape and a shape of the output area 214 can be a second shape that is different than the first shape. For example, a portion of the plunger 212 that interacts with the print material particles within the output area 214 can have a shape that is substantially flat with a border that is similar to the shape of the of the inner body 204, In this example, the shape of the output area 214 can be a funnel shaped area that includes a taper towards the output channel 208. In this example, the flat surface with a cylindrical border of the plunger 212 is different than the funnel shaped output area 214. In some examples, the shape of the plunger 212 can be different than the shape of the output area 214 to accommodate the print material particles when moving the print material particles toward the output channel 208.

In some examples, the print material particles dispenser 200 can include a central axis 220-2 and a width 220-1 that includes the output channel 208. In some examples, the central axis 220-2 can be a central axis for the output area 214 defined by lines 218-1, 218-2, In some examples, the line 218-1 can define a location of the print material particles dispenser 200 where the output area 214 begins to taper toward the output channel 208. In some examples, the output channel 208 can be positioned away from a central axis 220-2 of the print material particles dispenser 200, For example, the output channel 208 can be positioned toward an edge of the inner body 204 instead of being positioned at the central axis 220-2.

In some examples, the output channel 208 can be positioned on an edge of the output area 214 such that a first edge of the output area 214 is a same thickness as a side or edge of the inner body 204. In these examples, a second edge of the output area 214 can be greater than the first edge when the output channel 208 is positioned away from a central axis 220-2 of the print material particles dispenser 200. In this way, the print material particles within the inner body 204 can be directed to an edge of the inner body 204 when the structure 206 and/or plunger 212 is directed in the direction of arrow 216.

In some examples, the print material particles dispenser 200 can be utilized to dispense print material particles into a print material particle reservoir of an imaging device. The print material particles dispenser 200 can utilize a structure 206 and/or plunger 212 that has a shape that is different than the output area 214 to allow a better flow of print material particles compared to other print material dispensing devices. For example, the differently shaped structure 206 or plunger 212 can prevent jams or obstructions caused by the print material particles when the structure 206 or plunger 212 is moved in the direction of arrow 216.

Figure 3:
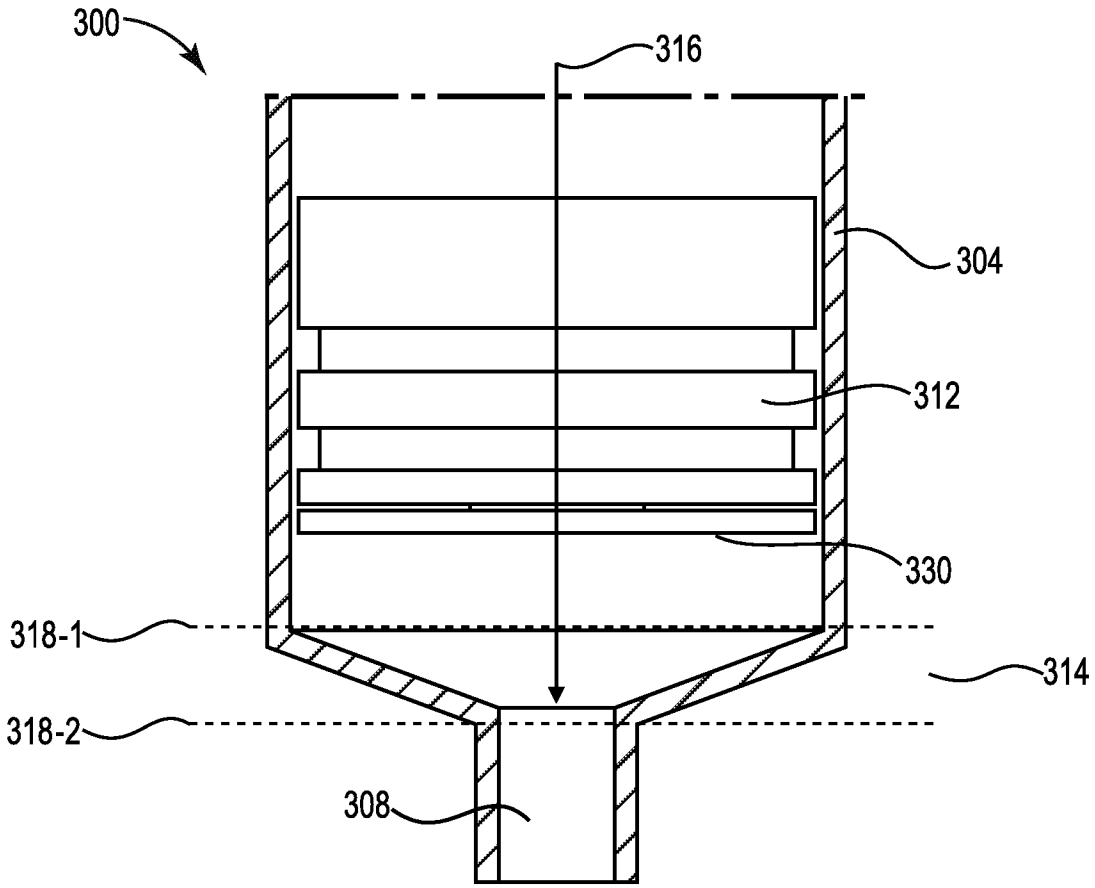
FIG. 3 illustrates a partial view of a portion of a print material particles dispenser consistent with the disclosure.

FIG. 3 illustrates a partial view of a portion of a print material particles dispenser 300 consistent with the disclosure. In some examples, the print material particles dispenser 300 can include the same or similar elements as the print material particles dispenser 100 as referenced in FIG. 1 and/or the print material particles dispenser 200 as referenced in FIG. 2. For example, the print material particles dispenser 300 can include an inner body 304 to store print material particles, an outer body covering the inner body, and a structure or plunger 312 located within the inner body 304. In some examples, the structure can include a plunger 312 to interact with the print material particles stored within the inner body 304. In some examples, the inner body 304 can define a print material particles area to store the print material particles.

As described herein, the inner body 304 can include an output area 314 that is defined by lines 318-1, 318-2. In some examples, the output area 314 can be a tapered portion of the inner body 304 to direct print material particles toward an output channel 308. As described herein, the output channel 308 can be positioned away from a central axis of the print material area defined by the inner body 304. In some examples, the output channel 308 can be positioned away from a central axis of the output area 314. In this way, the output area 314 can be utilized to direct the print material particles toward a side or edge of the output area 314 to be received by the output channel 308 when the plunger 312 is moved in the direction of the arrow 316.

In some examples, the inner body 304 can be in a shape of a cylinder. In these examples, the plunger 312 can be in a shape of the cylinder such that the plunger 312 can be moved in the direction of arrow 316 with a force and also move in a direction opposite of the arrow 316 with an opposite force. In some examples, the plunger 312 can include a surface 330. The surface 330 can be an area of the plunger 312 that can interact with the print material particles stored within the inner body 304 of the print material particles dispenser 300.

In some examples, the surface 330 can include a shape that is different than the shape of the output area 314. For example, the surface 330 can be a substantially flat surface or flat shape with edges in the shape of a cylinder or in the shape of the inner body 304. In this example, the flat surface or shape of the surface 330 can be different than the tapered or funnel shape of the output area 314. As described herein, print material particles may not be jammed or create a stoppage of the plunger 312 when the shape of the surface 330 of the plunger 312 is different than the shape of the output area 314.

Figure 4:
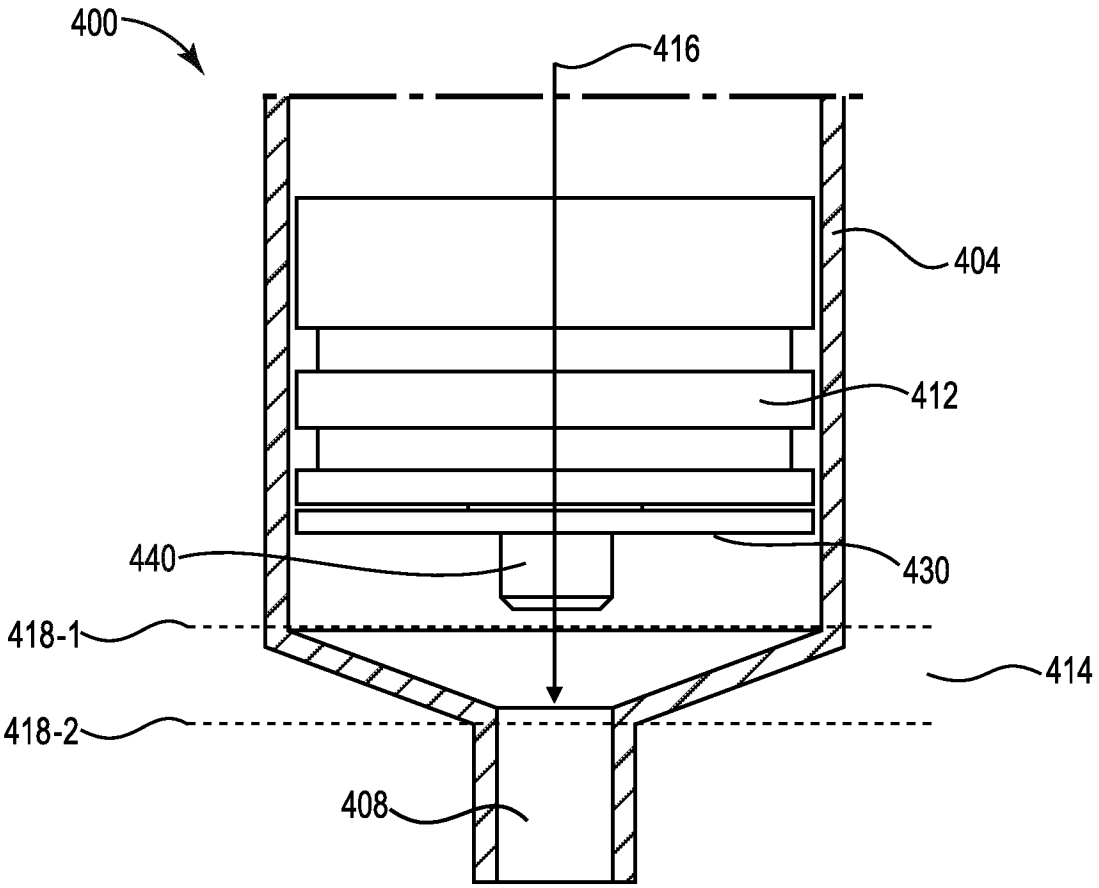
FIG. 4 illustrates a partial view of a portion of a print material particles dispenser consistent with the disclosure.

FIG. 4 illustrates a partial view of a portion of a print material particles dispenser 400 consistent with the disclosure. In some examples, the print material particles dispenser 400 can include the same or similar elements as the print material particles dispenser 100 as referenced in FIG. 1, the print material particles dispenser 200 as referenced in FIG. 2, and/or the print material particles dispenser 300 as referenced in FIG. 3.

For example, the print material particles dispenser 400 can include an inner body 404 to store print material particles, an outer body covering the inner body, and a structure or plunger 412 located within the inner body 404, In some examples, the structure can include a plunger 412 to interact with the print material particles stored within the inner body 404. In some examples, the inner body 404 can define a print material particles area to store the print material particles.

As described herein, the inner body 404 can include an output area 414 that is defined by lines 418-1, 418-2, In some examples, the output area 414 can be a tapered portion of the inner body 404 to direct print material particles toward an output channel 408. As described herein, the output channel 408 can be positioned away from a central axis of the print material area defined by the inner body 404, In some examples, the output channel 408 can be positioned away from a central axis of the output area 414. In this way, the output area 414 can be utilized to direct the print material particles toward a side or edge of the output area 414 to be received by the output channel 408 when the plunger 412 is moved in the direction of the arrow 416.

In some examples, the inner body 404 can be in a shape of a cylinder. In these examples, the plunger 412 can be in a shape of the cylinder such that the plunger 412 can be moved in the direction of arrow 416 with a force and also move in a direction opposite of the arrow 416 with an opposite force. In some examples, the plunger 412 can include a surface 430. The surface 430 can be an area of the plunger 412 that can interact with the print material particles stored within the inner body 404 of the print material particles dispenser 400.

In some examples, the surface 430 can include a shape that is different than the shape of the output area 414. For example, the surface 430 can be a substantially flat surface or flat shape with edges in the shape of a cylinder or in the shape of the inner body 404. In this example, the flat surface or shape of the surface 430 can be different than the tapered or funnel shape of the output area 414. As described herein, print material particles may not be jammed or create a stoppage of the plunger 412 when the shape of the surface 430 of the plunger 412 is different than the shape of the output area 414.

In some examples, the surface 430 can include a protrusion 440 that is insertable into the output channel 408. As used herein, a "protrusion" 440 can include a structure that can extend from a surface such as the surface 430. In some examples, a portion of the protrusion 440 can be inserted into the output channel 408 when the plunger 412 is moved in the direction of arrow 416. In some examples, the shape of the protrusion 440 can the same or similar shape as the shape of the output channel 408.

In some examples, the print material particles can accumulate within the output channel 408 such that the accumulated print material particles may prevent additional print material particles from passing through the output channel 408. In some examples, the protrusion 440 can be utilized to provide additional force on the output channel 408 when the plunger 412 is moved in the direction of the arrow 416. In some examples, the protrusion 440 can be utilized to clear the output channel 408 when the protrusion 440 is inserted into the output channel 408. Thus, a protrusion 440 can be utilized to better dispense the print material particles through the output channel 408 into a print material particle reservoir of an imaging device.

Figure 5:
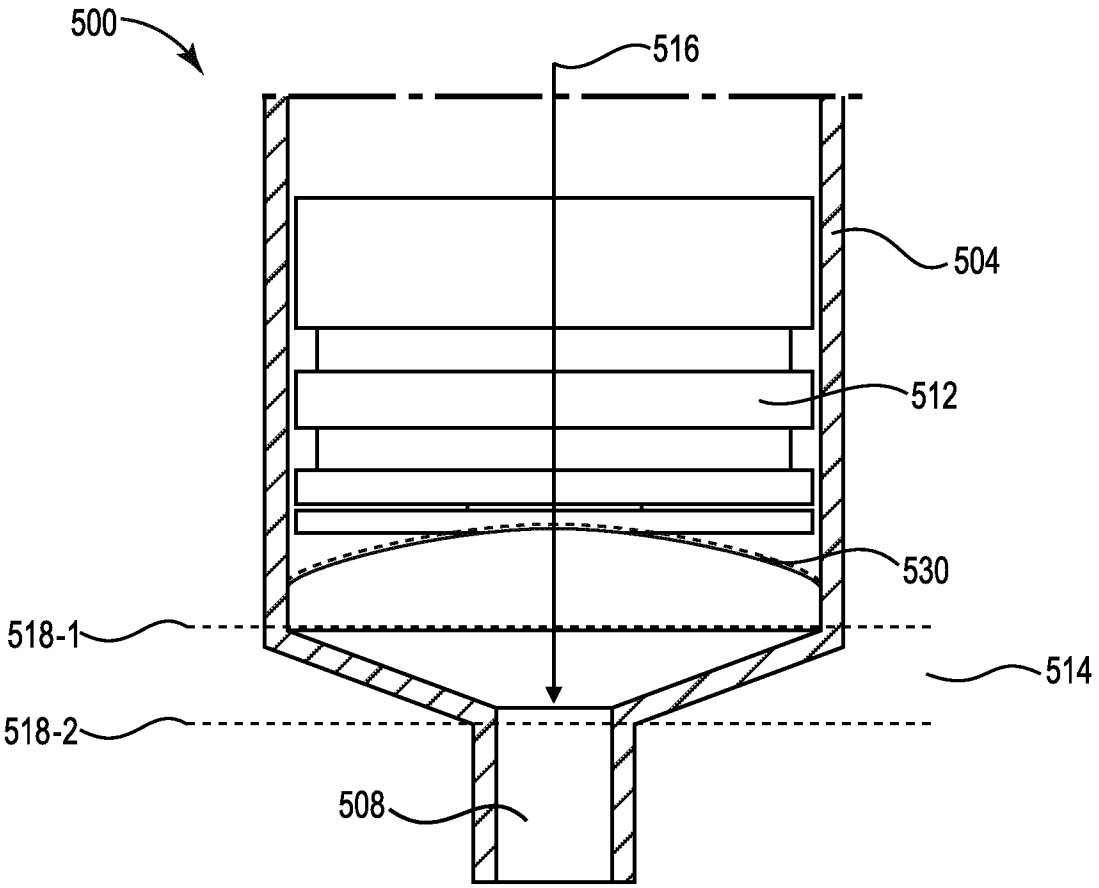
FIG. 5 illustrates a partial view of a portion of a print material particles dispenser consistent with the disclosure.

FIG. 5 illustrates a partial view of a portion of a print material particles dispenser 500 consistent with the disclosure. In some examples, the print material particles dispenser 500 can include the same or similar elements as the print material particles dispenser 100 as referenced in FIG. 1, the print material particles dispenser 200 as referenced in FIG. 2, the print material particles dispenser 300 as referenced in FIG. 3, and/or the print material particles dispenser 400 as referenced in FIG. 4.

For example, the print material particles dispenser 500 can include an inner body 504 to store print material particles, an outer body covering the inner body, and a structure or plunger 512 located within the inner body 504, In some examples, the structure can include a plunger 512 to interact with the print material particles stored within the inner body 504. In some examples, the inner body 504 can define a print material particles area to store the print material particles.

As described herein, the inner body 504 can include an output area 514 that is defined by lines 518-1, 518-2. In some examples, the output area 514 can be a tapered portion of the inner body 504 to direct print material particles toward an output channel 508. As described herein, the output channel 508 can be positioned away from a central axis of the print material area defined by the inner body 504. In some examples, the output channel 508 can be positioned away from a central axis of the output area 514. In this way, the output area 514 can be utilized to direct the print material particles toward a side or edge of the output area 514 to be received by the output channel 508 when the plunger 512 is moved in the direction of the arrow 516.

In some examples, the inner body 504 can be in a shape of a cylinder. In these examples, the plunger 512 can be in a shape of the cylinder such that the plunger 512 can be moved in the direction of arrow 516 with a force and also move in a direction opposite of the arrow 516 with an opposite force. In some examples, the plunger 512 can include a surface 530. The surface 530 can be an area of the plunger 512 that can interact with the print material particles stored within the inner body 504 of the print material particles dispenser 500.

In some examples, the surface 530 can include a shape that is different than the shape of the output area 514. In some examples, a portion of a structure (e.g., plunger 512, etc.) directed toward the output area 514 includes a concave shape with a recessed portion directed away from the output area 514. In some examples, the surface 530 can be a shape that is an inverse of the shape of the output area 514. For example, the output area 514 can be a funnel like shape or concave shape to direct the print material particles toward the output channel 508. In this example, the surface 530 can be in a concave shape in an opposite direction. For example, the surface 530 can be a shape with edges that are relatively closer to the output area 514 than a center portion of the surface 530. In this way, the print material particles within the inner body 504 can interact with the edges of the plunger 512 before interacting with a center portion of the surface 530 of the plunger 512. In some examples, the plunger 512 can remove print material particles from the edges before applying pressure to the print material particles within the inner body 504. As described herein, print material particles may not be jammed or create a stoppage of the plunger 512 when the shape of the surface 530 of the plunger 512 is different than the shape of the output area 514.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. Further, as used herein, "a" can refer to one such thing or more than one such thing.

The figures herein follow a numbering convention in which the first digit corresponds to the drawing figure number and the remaining digits identify an element or component in the drawing. For example, reference numeral 102 may refer to element 102 in FIG. 1 and an analogous element may be identified by reference numeral 202 in FIG. 2. Elements shown in the various figures herein can be added, exchanged, and/or eliminated to provide additional examples of the disclosure. In addition, the proportion and the relative scale of the elements provided in the figures are intended to illustrate the examples of the disclosure and should not be taken in a limiting sense.

It can be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" another element it is understood that are no intervening elements (adhesives, screws, other elements) etc.

The above specification, examples and data provide a description of the method and applications, and use of the system and method of the disclosure. Since many examples can be made without departing from the spirit and scope of the system and method of the disclosure, this specification merely sets forth some of the many possible example configurations and implementations.

What is claimed is:

1. A print material particles dispenser, comprising:

a body defining a print material area comprising an output area that includes an output channel that is positioned away from a central axis of the print material area, wherein the output area comprises a tapered portion that tapers towards the output channel; and a structure moveable in the print material area towards the tapered portion to decrease a volume of the print material area to output print material particles through the output channel of the print material area.

2. The print material particles dispenser of claim 1, wherein a shape of the structure is different than a shape of the output area.

3. The print material particles dispenser of claim 1, wherein the output area is to direct print material particles toward the output channel.

4. The print material particles dispenser of claim 1, wherein the body has a cylindrical shape.

5. The print material particles dispenser of claim 4, wherein the output channel is positioned away from a central axis of the body.

6. The print material particles dispenser of claim 1, wherein the output area has a concave shape with a recessed portion directed toward the output channel.

7. The print material particles dispenser of claim 6, wherein a portion of the structure directed toward the output area includes a flat surface.

8. The print material particles dispenser of claim 6, wherein a portion of the structure directed toward the output area includes a concave shape with a recessed portion directed away from the output area.

9. The print material particles dispenser of claim 1, wherein the tapered portion of the output area is defined by a tapered wall of the body.

10. The print material particles dispenser of claim 1, wherein the structure comprises a plunger.

11. The print material particles dispenser of claim 1, wherein the structure comprises a protrusion insertable into the output channel when the structure is moved to the tapered portion.

12. The print material particles dispenser of claim 1, wherein the structure has a shape that prevents the structure from entering the output area.

13. A print material particles container to output print material particles to an imaging device, comprising:

a print material area with an output area that includes an output channel that is positioned away from a central axis of the print material area; and a structure positioned within the print material area to decrease a volume of the print material area to output the print material particles through the output channel of the print material area, wherein a portion of the structure that interacts with the print material particles has a shape that is different than a shape of the output area, and wherein the portion of the structure that interacts with the print material particles comprises a different material than a remaining portion of the structure.

14. The print material particles container of claim 13, wherein the structure comprises a plunger.

15. The print material particles container of claim 13, wherein the portion of the structure that interacts with the print material particles includes a protrusion that is insertable into the output channel.

16. A system comprising:

a print material dispenser, comprising:

a storage area with a cylindrical shape to store print material particles;

an output area coupled to the storage area and that includes an output channel that is positioned away from a central axis of the storage area, wherein the output channel is for coupling to an input channel of an imaging device;

a structure positioned within the storage area to decrease a volume of the storage area to output the print material particles through the output channel of the storage area into the imaging device when the output channel is coupled to the input channel; and a plunger coupled to the structure to interact with the print material particles, wherein the plunger has a shape that is different than a shape of the output area, and wherein the shape of the plunger prevents the plunger from entering the output area.

17. The system of claim 16, wherein the plunger includes a protrusion that is insertable into the output channel.

18. The system of claim 16, wherein the output area includes a shape that is asymmetrical.

19. The system of claim 16, wherein the plunger includes a shape that is an inverse of the shape of the output area.

20. The system of claim 16, wherein the output area comprises a tapered portion that tapers towards the output channel.

* * * * *